United States Patent [19]

Flemming

[11] Patent Number: 4,858,343

[45] Date of Patent: Aug. 22, 1989

[54] SOLE FOR ATHLETIC SHOES, PARTICULARLY FOR SOCCER SHOES

[75] Inventor: Udo Flemming, Erlangen, Fed. Rep. of Germany

[73] Assignee: Puma AG Rudolf Dassler Sport, Herzogenaurach, Fed. Rep. of Germany

[21] Appl. No.: 158,644

[22] Filed: Feb. 22, 1988

[30] Foreign Application Priority Data

Feb. 25, 1987 [DE] Fed. Rep. of Germany ..... 3706071

[51] Int. Cl.[4] ..... A43B 5/00; A34C 15/00

[52] U.S. Cl. ..... 36/128; 36/59 R; 36/67 A; 36/134; D2/311

[58] Field of Search ..... 36/128, 67 A, 67 R, 36/59 R, 32 R, 107, 108, 134, 59; D2/311, 317

[56] References Cited

U.S. PATENT DOCUMENTS

| | | | |
|---|---|---|---|
| 3,341,952 | 9/1967 | Dassler | 36/134 X |
| 4,130,947 | 12/1978 | Denu | 36/32 R |
| 4,255,874 | 3/1981 | Sironi | 36/32 R |
| 4,392,312 | 7/1983 | Crowley et al. | 36/128 X |
| 4,454,662 | 6/1984 | Stubblefield | 36/59 R |
| 4,574,498 | 3/1986 | Norton et al. | 36/67 A |
| 4,641,438 | 2/1987 | Laird et al. | 36/59 R |

FOREIGN PATENT DOCUMENTS

| | | | |
|---|---|---|---|
| 2022974 | 11/1971 | Fed. Rep. of Germany | 36/128 |
| 2324706 | 12/1973 | Fed. Rep. of Germany | 36/128 |
| 2927635 | 1/1981 | Fed. Rep. of Germany | 36/128 |
| 430706 | 2/1948 | Italy | 36/67 A |
| 2020161 | 11/1979 | United Kingdom | 36/59 R |

*Primary Examiner*—James Kee Chi

*Attorney, Agent, or Firm*—Sixbey, Friedman, Leedom & Ferguson

[57] ABSTRACT

A sole for athletic shoes, particularly soccer shoes, made of a lightweight plastic construction having a reinforcement web provided between the ball region and the heel for the attachment of gripping elements is improved so that a greater resistance to twisting, at least in the midfoot section, is achieved without the weight of the sole being increased. This is achieved in that the reinforcement web is positioned to running diagonally from a lateral side of the ball region over sole to the medial side of the heel. Additionally, a diagonal web may be provided running from a medial side of the ball region to the small toe region.

24 Claims, 1 Drawing Sheet

FIG. 1
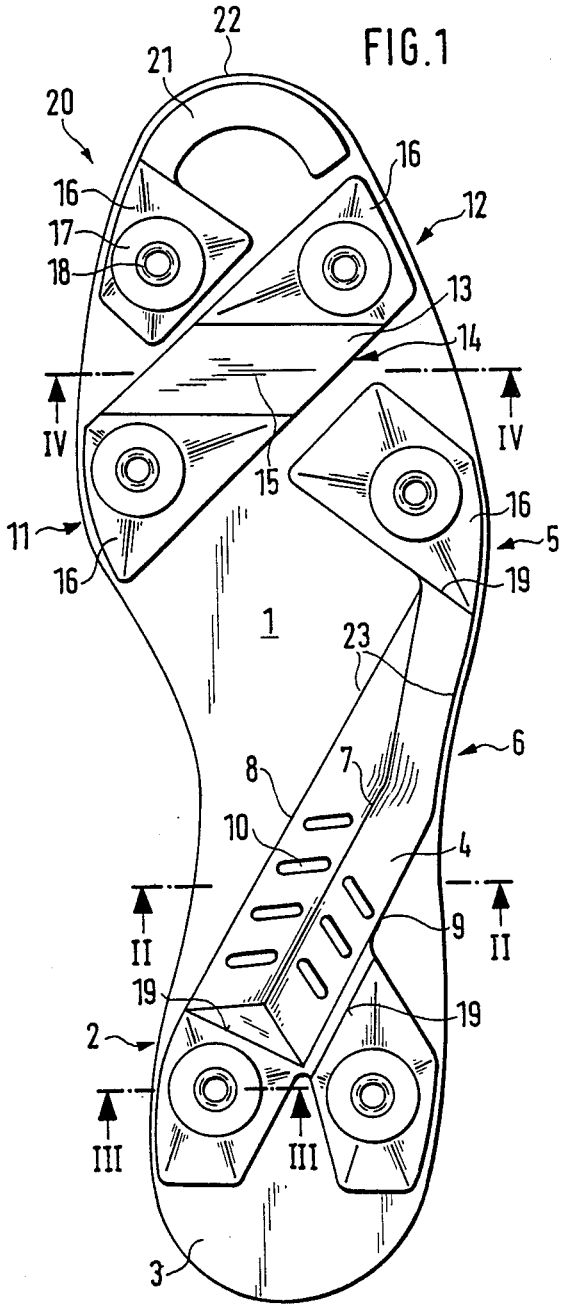
FIG. 4
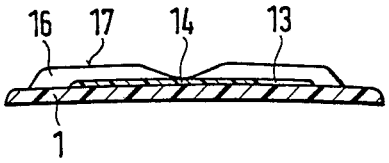
FIG. 2
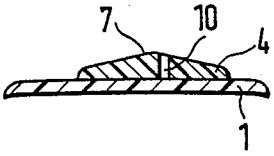
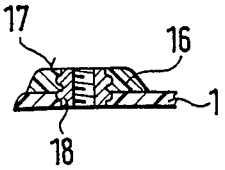
FIG. 3

SOLE FOR ATHLETIC SHOES, PARTICULARLY FOR SOCCER SHOES

BACKGROUND AND SUMMARY OF THE INVENTION

The present invention relates to a plastic sole for athletic shoes, particularly for soccer shoes, of a lightweight construction having a reinforcing web between the regions of the ball and heel of the foot.

A sole of such a lightweight construction is known from German Offenlegungsschrift 20 22 974. In this known sole, webs that reinforce the sole are produced with the sole from a homogeneous material. The reinforcing webs run slanted over the front ball area and also slanted over the middle ball area and toward the rear to the heel over a narrow middle section, in the midsection of the foot, to an end section that extends slanted over the heel. This kind of sole for sport shoes, particularly soccer shoes, can very easily be twisted in the midsection of the foot. This twisting occurs especially when braking, stamping down or accelerating is done with the inner side of the heel of the sport shoe.

Thus, a primary object of the present invention is to create a sole for athletic shoes, particularly soccer shoes, of the kind described above, that has a higher resistance to twisting, at least in the midsection of the foot, but without increasing the weight of the sole.

The object is achieved by the features of a preferred embodiment of the invention wherein a reinforcing web is placed so as to run diagonally over the sole from the outer (lateral) ball area to the inner (medial) side of the heel. The invention is distinguished, in particular, by the fact that the diagonally placed web has an anti-torsion effect, especially when walking or stamping down is done at the medial side of the heel of the shoe.

According to a further advantageous aspect of the invention, the web is attached to the sole as a special part. This makes it possible to better match the material of the sole and web to the desired qualities of the sole, or of an athletic shoe provided with such a sole.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 shows a sole according to a preferred embodiment of the invention in a bottom plan view;

FIG. 2 is a cross-sectional view taken along line II—II of FIG. 1;

—IG. 3 is a cross-sectional view taken along line III—III of FIG. 1; and FIG. 4 is a cross-sectional view taken along line IV—IV of FIG. 1.

DETAILED DESCRIPTION OF THE PREFERRED EMBODIMENT

A sole for an athletic shoe, particularly for a shoe used in sports play on natural turf, such as soccer, is designated by the reference numeral 1. This sole, for reasons having to do with saving weight, is made of a hard, flexible plastic, for example, a plastic having a base of polyurethane, polyimide, polyamide, polycarbonate or mixtures of these plastics. The thickness of sole 1 is about 1.5 to 3 mm, particularly 2 mm. Because of this, the sole is very light and still exhibits the necessary strength.

To increase the resistance of sole 1 to twisting during stepping, accelerating or stopping with the inner (medial) side 2 of heel 3, an anti-torsion member, in the form of a web 4, is attached running diagonally from outer (lateral) ball 5 to the medial side 2 of heel 3. This web 4 can be a homogeneous part of sole 1 and thus, for example, may be injected or cast with sole 1. However, advantageously, web 4 is an independent component that is permanently connected with sole 1, such as by gluing or in a molding process, preferably a casting process. Web 4 can, basically, consist of the same initial material as sole 1, but with a differing flexibility and hardness selected according to the torsion resistance desired.

Web 4 is tapered in cross section, particularly continuously decreasing toward lateral ball 5. Advantageously, the lateral tapering starts at midfoot section 6 by providing web 4 with a smaller width and/or height in the midfoot section. Preferably, web 4 is formed so that it tapers outwardly at a slant, from its center line or ridge line 7 (or close thereto) toward both sides 8, 9, in order to achieve a gradual transition into sole 1. Crosswise to center line 7, openings 10, in the form of slots, elongated slots, holes or, also, in the form of a series of holes or other similar openings, may be provided in web 4. On one hand, these openings 10 save weight and, on the other hand, guarantee that desirable rolling or bending characteristics of the sole are not lost, i.e., that a great resistance to rolling or bending does not result.

From inner ball region 11 to the little toe region 12, a further diagonal web 13 may be provided. Web 13 runs essentially in the same direction as web 4 (i.e., rearwardly from the lateral side to the medial side) and acts in a similar way. Midsection 14 of diagonal web 13 is reduced in cross section to guarantee a good bending of sole 1 (see FIG. 4). Additionally, crosswise grooves 15 can be provided in midsection 14 (and also is sole 1) in this area to facilitate flexing.

At the usual tread points, sole 1 is provided with somewhat trapezoidally-shaped raised parts 16, for example in the form of studs or cleats, or it has a supporting surface 17 in which, preferably centered, a fastening element, formed as screw socket 18 for fastening exchangeable cleats, is provided, particularly by being molded in. Such a raised part 16 is provided on each of the ends of diagonal web 13 and forms, with the latter, a structural unit. Likewise, similar raised parts 16 are formed as a structural unit with web 4, one raised part 16 being located in lateral ball region 5, and two such raised parts being provided in heel region 3. The connection of the raised parts 16 of web 4 is, preferably achieved via recessed junctions 19.

A further raised part 16 is provided in big toe region 20. An arc-shaped strip 21 of about 0.5 to 1.5 mm in thickness is formed on raised part 16, and extends along sole tip 22. This raised part 16, however, is not connected to diagonal web 13.

The width of web 4 is about 2.5 to 3.5 cm, particularly 3 cm. Its height is, when untapered, about 1 to 3 mm. In the tapered embodiment, the greatest height is about 2 to 4 mm at center line 7. This tapering is done so that edge 23 exhibits a maximum height of about 1 mm.

In a method of constructing sole 1 with web 4, diagonal web 13 and raised parts 16 being separate components, the sole preferably is formed of a polyamide having a hardness of about 45 to 65 Shore A and the other parts mentioned having a hardness of about 55 to 75 Shore A while being stiffer than the sole, preferably by an amount corresponding to the difference in said ranges. The production occurs, preferably, so that the web 4, diagonal web 13 and arcshaped strip 21 are inserted, with raised parts 16, into an injection mold or compression mold and sole 1 is formed to them. Thus, a secure fastening of these parts with sole 1 is achieved.

The present invention is suited, not only for soccer shoes, field hockey shoes or the like, but can be used for all kinds of games on lawns, sandy areas, or any other soft or deep ground.

By plastic soles made of a lightweight construction it should be understood that structures in which the actual outsole is kept as thin as possible, while still being able to withstand the occurring loads, is intended. Sole reinforcements are provided only in those sole areas that are supports for gripping elements, particularly cleats, or are used, along with the gripping elements, to distribute compression as, for example, compression distribution disks 16 in the region of screw socket 18, according to FIG. 1.

The present sole for athletic shoes, particularly soccer shoes, is distinguished by the fact that the ball and heel parts are resistant to twisting and that the sole possesses outstanding stability. Further, the easily flexed ball part allows an optimal adaptation to the ground covering, especially to grass surfaces. Also, the trapezoidally-shaped cleat supports 16, formed around the thread, reduce cleat compression to a minimum.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Sole for athletic shoes, particularly soccer shoes, made of a thin lightweight plastic construction with a reinforcing web provided between the ball and heel regions of the sole for the attachment of gripping elements, wherein a portion of the reinforcing web that is free of gripping elements runs over the sole diagonally from a lateral side of the ball region to a medial side of the heel region as a means for producing an anti-torsion effect.

2. Sole according to claim 1, wherein said reinforcing web portion is formed with a part of reduced cross section from about a midfoot section out toward the lateral side of the ball region. line out toward both sides.

3. Sole according to claim 2, wherein the cross section of said part is reduced continuously.

4. Sole according to claim 1, wherein said portion of the reinforcing web tapers at a slant from about a center line out toward both sides.

5. Sole according to claim 4, wherein said portion of the reinforcing web is provided with recesses that run crosswise to its center line.

6. Sole according to claim 1, wherein said portion of the reinforcing web is provided with recesses that run crosswise to a center line.

7. Sole according to claim 1, wherein a diagonal web is provided that runs from a medial side of the ball region to a small toe region.

8. Sole according to claim 7, wherein said diagonal web is reduced in cross section in a midsection.

9. Sole according to claim 8, wherein crosswise grooves are provided in said midsection.

10. Sole according to claim 7, wherein a raised part is provided in a big toe area, and wherein said raised part is integrally joined with a flat arc-shaped strip that extends along a tip of the sole, as a structural unit that is permanently connected with the sole.

11. Sole according to claim 10, wherein said raised part is separate from said diagonal web.

12. Sole according to claim 7, wherein said portion of the reinforcing web forms a structural unit with a raised part in the lateral side of the ball region and with two raised parts in the heel region, said structural unit being permanently attached to the sole.

13. Sole according to claim 7, wherein the diagonal web forms a structural unit with a raised part on each end and the structural unit is permanently connected with the sole.

14. Sole according to claim 13, wherein the sole has a hardness of about 45 to 65 Shore A and the reinforcing web, diagonal web and raised parts are stiffer then the sole and have a hardness of about 55 to 75 Shore A.

15. Sole according to claim 14, wherein screw sockets for exchangeable cleats are molded into said raised parts.

16. Sole according to claim 1, wherein the width of the reinforcing web is about 2.5 to 3.5 cm.

17. Sole according to claim 16, wherein the height of the reinforcing web is 1 to 3 mm.

18. Sole according to claim 4, wherein the maximum height of the reinforcing web is 2 to 4 mm.

19. Sole according to claim 18, wherein an edge of the reinforcing web is about 1 mm high.

20. Sole according to claim 1, wherein said portion of the reinforcing web forms a structural unit with a raised part in the lateral side of the ball region and with two raised parts in the heel region, said structural unit being permanently attached to the sole.

21. Sole according to claim 1, wherein the sole has a hardness of about 45 to 65 Shore A and said reinforcing web has a greater hardness than that of the sole and is in a range of about 55 to 75 Shore A.

22. Sole according to claim 21, wherein a diagonal web is provided that runs from a medial side of the ball region to a small toe region.

23. Sole according to claim 12, wherein screw sockets for exchangeable cleats are molded into said raised parts.

24. Sole for athletic shoes, particularly soccer shoes, made of a thin lightweight plastic construction and having a reinforcing web provided between the ball and heel regions of the sole comprised of regions for the attachment of gripping elements and an anti-torsion web portion extending continuously from a lateral side of the ball region diagonally across the sole to a medial side of the heel region.

* * * * *